US010752473B2

(12) United States Patent
Krupinski

(10) Patent No.: US 10,752,473 B2
(45) Date of Patent: Aug. 25, 2020

(54) METHOD OF MONITORING CRANE SAFETY AND A SYSTEM FOR MONITORING CRANE SAFETY

(71) Applicant: Liebherr-Werk Biberach GmbH, Biberach (DE)

(72) Inventor: Jacek Krupinski, Trier (DE)

(73) Assignee: Liebherr-Werk Biberach GmbH, Biberach (DE)

( * ) Notice: Subject to any disclaimer, the term of this patent is extended or adjusted under 35 U.S.C. 154(b) by 423 days.

(21) Appl. No.: 15/539,000

(22) PCT Filed: Dec. 9, 2015

(86) PCT No.: PCT/EP2015/002495
§ 371 (c)(1),
(2) Date: Jun. 22, 2017

(87) PCT Pub. No.: WO2016/102050
PCT Pub. Date: Jun. 30, 2016

(65) Prior Publication Data

US 2017/0369287 A1 Dec. 28, 2017

(30) Foreign Application Priority Data

Dec. 23, 2014 (DE) ..... 10 2014 019 465

(51) Int. Cl.
*B66C 15/06* (2006.01)
*B66C 23/26* (2006.01)
(Continued)

(52) U.S. Cl.
CPC ..... *B66C 15/065* (2013.01); *B66C 23/26* (2013.01); *B66C 23/76* (2013.01); *B66C 23/905* (2013.01); *B66C 23/82* (2013.01)

(58) Field of Classification Search
CPC ..... B66C 15/00; B66C 15/06; B66C 15/065; B66C 23/26; B66C 23/76; B66C 23/82; B66C 23/88; B66C 23/905
See application file for complete search history.

(56) References Cited

U.S. PATENT DOCUMENTS 5,609,260 A * 3/1997 Liao ..... B66C 23/26 212/198
2003/0127409 A1 7/2003 Verchere
(Continued)

FOREIGN PATENT DOCUMENTS

AT 513 283 B1 3/2014
DE 28 39 419 A1 3/1980
(Continued)

*Primary Examiner* — Sang K Kim
*Assistant Examiner* — Nathaniel L Adams
(74) *Attorney, Agent, or Firm* — Dilworth & Barrese, LLP

(57) ABSTRACT

The invention relates to a method of monitoring the safety of a crane, in particular of a revolving tower crane having a revolving deck, wherein the crane has a sensor system and a crane control, and wherein furthermore at least one tilt sensor is provided. In accordance with the invention, the at least one tilt sensor is attached to the revolving deck of the revolving tower crane, with the monitoring of the crane safety taking place at least during the putting up and/or taking down of the revolving tower crane.

15 Claims, 13 Drawing Sheets

(51) Int. Cl.

| | |
|---|---|
| ***B66C 23/90*** | (2006.01) |
| ***B66C 23/76*** | (2006.01) |
| *B66C 23/82* | (2006.01) |

(56) References Cited

U.S. PATENT DOCUMENTS

| | | | | |
|---|---|---|---|---|
| 2009/0125196 | A1* | 5/2009 | Velazquez | B66C 23/905 701/50 |
| 2012/0271582 | A1* | 10/2012 | Bageshwar | B66C 13/46 702/92 |
| 2012/0312767 | A1* | 12/2012 | Bohnacker | B66C 13/46 212/276 |

FOREIGN PATENT DOCUMENTS

| | | | |
|---|---|---|---|
| DE | 602 23 897 | T2 | 11/2008 |
| EP | 1 491 486 | A1 | 12/2004 |
| JP | 2008-189401 | A | 8/2008 |

* cited by examiner

METHOD OF MONITORING CRANE SAFETY AND A SYSTEM FOR MONITORING CRANE SAFETY

The present application relates to a method of monitoring crane safety, in particular of a revolving tower crane, as well as to a system for monitoring the inclination of a crane.

BACKGROUND OF THE INVENTION

Revolving tower cranes are put up and taken down very frequently. In this respect, the required precautions have to be taken so that an appropriate safety level is ensured; the required stability of the crane should in particular be ensured.

The monitoring of the stability of a crane currently takes place in a known manner by measuring secondary values at the crane. In this respect, a torque is monitored that is a consequence of the loading of the crane with a load torque. All other influences are not considered. These influences are, for example, errors in the putting up of the crane, e.g. when it is incorrectly leveled, settling of the substructure, tolerances in putting up the tower, wind, etc.

To determine the inclination of the crane, it is as customary in excavating machines or in mobile cranes to use tilt sensors that are very robust and precise and that serve either to monitor the stability of the machine or to improve the quality of the work to be carried out. The position of the upper crane with respect to the tower system and to the substructure is, however, not taken into account at all.

It is customary to use square tower systems. The stability is only identical in individual points in this respect. An apparatus is provided in a known manner for a continuous determination of the stability having four observation points spaced apart from one another, said apparatus having devices for detecting values decisive for the stability. These devices forward the detected values to a comparison device for comparison with previously determined maximum permitted values or switch off directly. On an exceeding of a predefined fixed value at an observation point, a monitoring signal is output that indicates that the stability is no longer present. The stability changes on a rotation of the crane.

The currently used systems thus only take account of a defined and maximum stability without considering the position of the upper crane. Situations on the putting up of the crane are furthermore currently excluded from the monitoring, which could have devastating consequences on the putting up. The monitoring of the stability only starts after the crane has been put up in known systems. Situations also arise in use that are not currently detected, e.g. settling in the substructure or damage.

SUMMARY OF THE INVENTION

It is therefore the object of the present invention to provide a method of monitoring crane stability and a system for monitoring the inclination of a crane, in particular of a revolving tower crane, such that the stability of the crane is ensured during the setting up and taking down of the crane and such that the quality of the work carried out is substantially improved.

The method in accordance with the invention of monitoring the safety of a crane, in particular of a revolving tower crane having a revolving deck, that has a sensor system and a crane control furthermore has at least one tilt sensor in a manner known per se. In accordance with the invention, the at least one tilt sensor is attached to the revolving deck of the revolving tower crane, with the monitoring of the safety still and at least starting during the putting up and/or taking down of the revolving tower crane. In this respect, the at least one tilt sensor has an exact resolution and can take over an independent monitoring of the crane.

It is, however, also possible to use the tilt sensor as supplement to existing safety devices to increase the accuracy of the monitoring and thus the safety. The putting up of the tower can be immediately corrected in the case of an impermissible inclination of the revolving deck during the putting up of the crane due to the inclination monitoring of the crane in accordance with the invention still during the putting up.

The position of the revolving deck is preferably determined via the at least one tilt sensor. The received measured values are then transmitted to the crane control for evaluation, with an action being triggered on an exceeding of a limit value. It can be an acoustic and/or visual signal so that the mechanic is immediately informed of the exceeding of the limit value. The putting up can thereupon be automatically, or also manually, aborted.

The putting up of a revolving tower crane starts in a known manner with the assembly of the substructure and of the tower. The revolving deck is thereupon put on with the installed at least one tilt sensor. Monitoring in accordance with the method in accordance with the invention starts after the placing on of the revolving deck that is already provided with the at least one tilt sensor. The at least one tilt sensor is in this respect attached to a suitable point of the revolving deck so that it shows the position of the revolving deck. The inclination of the revolving deck is compared with the inclination provided for the respective structure via the values determined by the at least one tilt sensor, with a warning signal being output on an exceeding of the permitted inclination. The detected data are then logged. The crane control in this respect has a memory unit in which the detected values are stored.

A correction of the data determined by the at least one tilt sensor can preferably be carried out in conjunction with the values determined via a wind gauge so that a release is given for further assembly steps.

In a further step, the counter-boom is assembled, with the counter-boom and the hoist winch generating a torque from which an inclination results as a consequence in dependence on the height of the tower. This inclination can then be determined by the at least one tilt sensor and can be compared with data stored in the crane control.

It is considered particularly preferable if an angle of rotation sensor is used in addition to the at least one tilt sensor to determine the position-dependent inclination of the tower, and indeed at a right angle or perpendicular to the wall. A 360° rotation can completely map the inclination pattern—also in conjunction with the wind measurement. The release thereupon takes place for further assembly steps, in particular for the placing on of the required assembly counter-ballast.

The inclination, in particular the angle of inclination, is determined after the assembly of the counter-ballast and is compared with the stored, predefined values. A permissible, but also necessary inclination confirms that the counter-ballast matches the assembled boom length.

The inclination is preferably noted again after the assembly of the boom to log an intermediate step.

The monitoring in accordance with the invention by the at least one tilt sensor preferably takes place not only on the putting up, but also on the taking down of the boom and/or counter-boom. If in this respect the horizontal force is greater than permissible, the inclination increases and in accordance with the invention a warning signal is output on an exceeding of permissible inclination values.

A correction of the data determined by the at least one tilt sensor can be carried out in conjunction with values determined via a provided wind gauge so that a release can take place for further assembly steps.

It is considered particularly preferable if the inclinations recorded in the crane control in the form of a load curve are compared with current load torques. In this respect, any deviations are logged and evaluated.

The angle of inclination in dependence on the load torque/static torque and the angle of rotation of the crane is preferably constantly monitored during operation after the erection, with deviations from permissible, stored values being displayed. The monitoring of the effect of wind can be dispensed with in this respect. The effect of wind can change the inclination in accordance with the wind speed. Influences that have not been foreseen such as an ice layer, advertising signs, etc. also have to be automatically taken into account in this respect. If these deviations exceed the permitted limit values, a warning signal is output and operation may be aborted as required.

On a monitoring in accordance with the invention that can also be a remote monitoring, and indeed in operation or out of operation, whether the crane substructure has been correctly put up can be determined very fast. An exact monitoring of special lifts can also take place with the method in accordance with the invention.

The above-named object is also achieved in accordance with the invention by a system for monitoring the crane safety of a crane, in particular of a revolving tower crane having a revolving deck, having the features herein. The system in accordance with the invention has a sensor system and a crane control, with at least one tilt sensor attached to a revolving deck being provided for monitoring safety during at least the putting up and dismantling of the revolving tower crane or also during the operation of the erected crane.

The method in accordance with the invention and the system in accordance with the invention can furthermore be used in the monitoring of the so-called climbing procedure. The maximum permitted deviation for each tower system can be achieved in this respect and can be stored in the monitoring system. A compensation can also take place in accordance with the specification of the respective system. In this respect, the fact can be considered particularly advantageous that all the external influences such as the wind, the sum of the tolerances at the tower, additional loads such as due to the amount of rope, etc. can be taken into account in the inclination monitoring.

The leveling of a tower crane revolving at the bottom can also be considered an additional possibility for the already installed tilt sensor.

BRIEF DESCRIPTION OF THE DRAWINGS

Further features, details and advantages of the invention will be explained in more detail with reference to embodiments shown in the drawings. There are shown.

DESCRIPTION OF THE PREFERRED EMBODIMENTS

Figure 1:
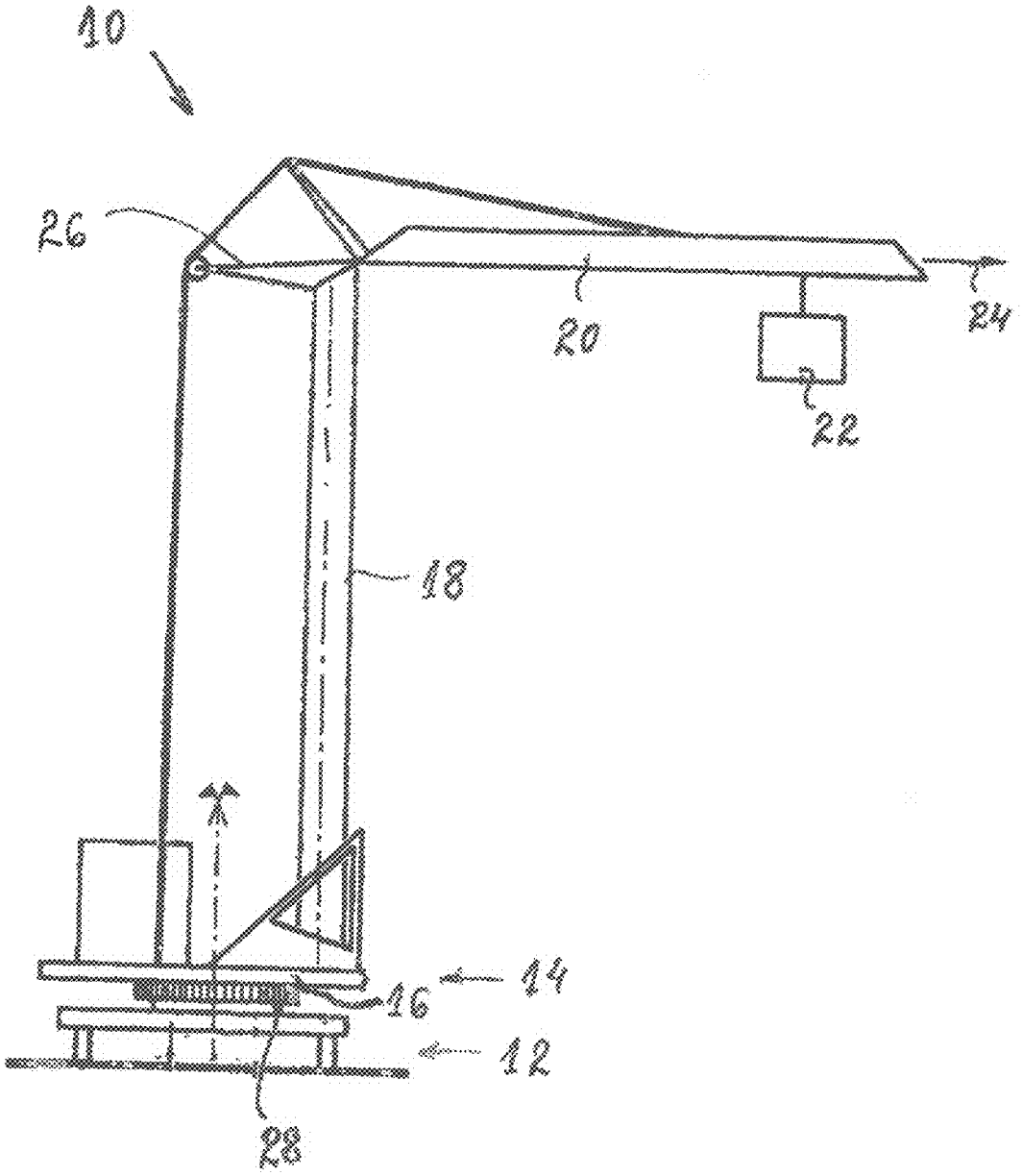
FIG. 1 a simplified schematic side view of a revolving tower crane in accordance with a first embodiment of the invention with a tilt sensor for carrying out the method in accordance with the invention shown schematically.

FIG. 1 shows a simplified schematic side view of a revolving tower crane 10 (here as a revolving tower crane revolving at the bottom) having a substructure 12 and a revolving tower 14 that has a revolving deck 16. The crane 10 furthermore has a tower 18 as well as a boom 20 fastened to the tower 18. A trolley, not shown in any more detail, having a lifting hook at which the load 22 is suspended is located at the boom 20. The trolley slides along the boom 20 in a horizontal direction that is shown by an arrow 24. The crane 10 furthermore has a counter-boom 26.

The system in accordance with the invention for monitoring the stability of the revolving tower crane 10 has a sensor system and a crane control now shown in any more detail here. A tilt sensor 28 having a very exact resolution is installed at the revolving deck 16 such that the position of the revolving deck 16 can be easily determined.

The actual monitoring starts in accordance with the invention in the putting up of the crane 10, with first the substructure 12 and the mast or the tower 18 being assembled in a manner known per se and only then the revolving tower 16 having the already installed tilt sensor 28 being put on. The tilt sensor 28 shows the position of the revolving deck 16. If the inclination of the revolving deck is larger than that intended for the tower height, the mechanic is informed and the received and evaluated data are then logged.

Figure 2:
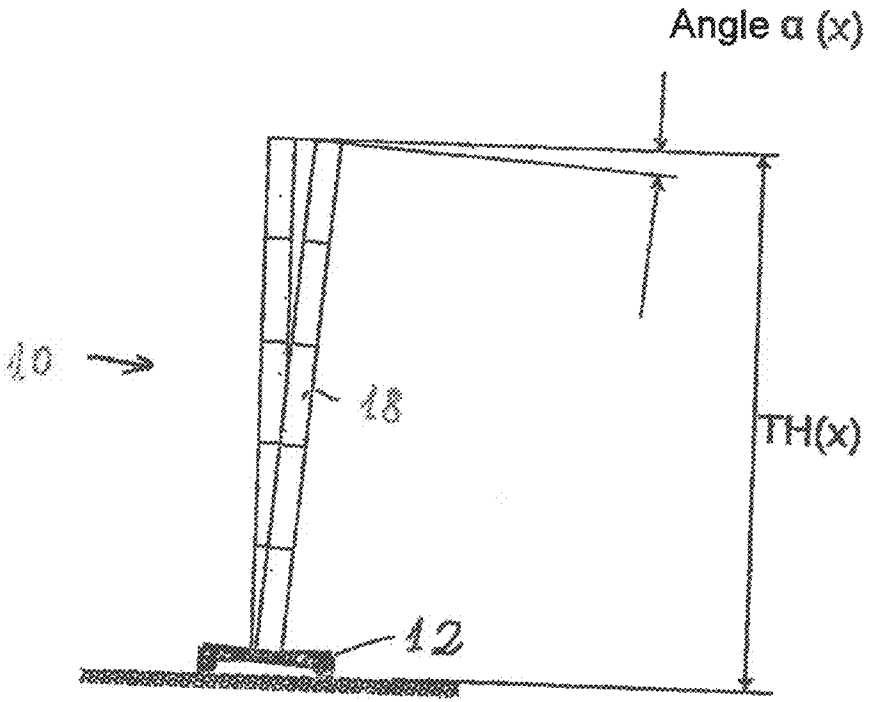
FIGS. 2-3 a simplified schematic side view of a revolving tower crane with a substructure and a tower.
Figure 3:
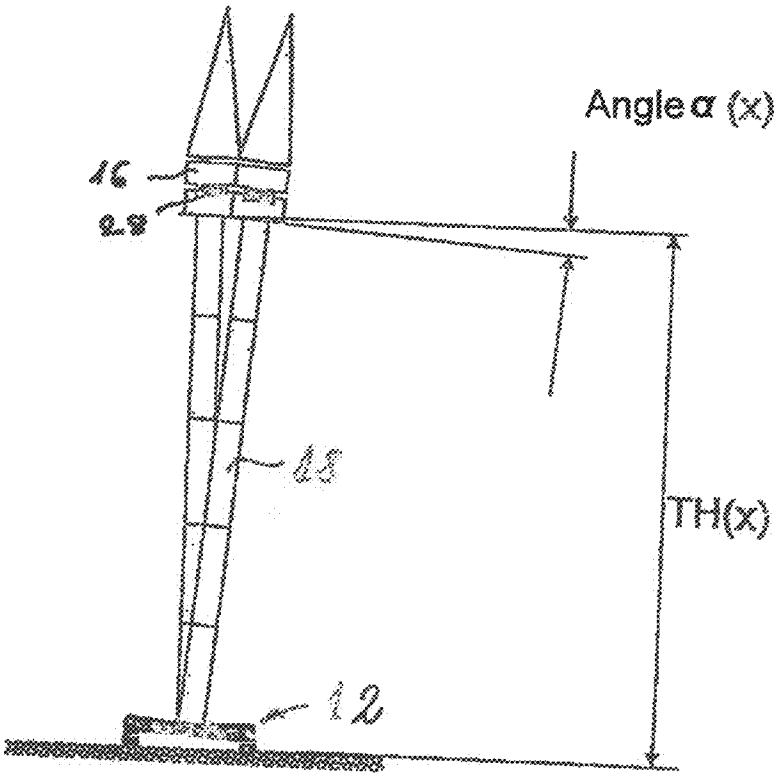

FIGS. 2 and 3 show a simplified schematic view of a crane 10 (here as a revolving tower crane revolving at the top) with the revolving deck 16 and the tower 18. The inclination of the revolving deck 16 is determined using the angle $\alpha(x)$, as shown in FIGS. 2 and 3, in dependence on the tower height/tower combination, TH(x) via the tilt sensor 28 and is compared with permitted inclination values stored in the crane control. If the inclination is within the permitted limits, the erection of the crane is continued. If, however, the inclination of the revolving deck is larger than that intended for the respective setup (tower height), a warning signal is output so that the mechanic is immediately informed and the further putting up of the crane is interrupted. The erection is then continued after a correction. A plurality of tilts sensors can also be provided.

Figure 4:
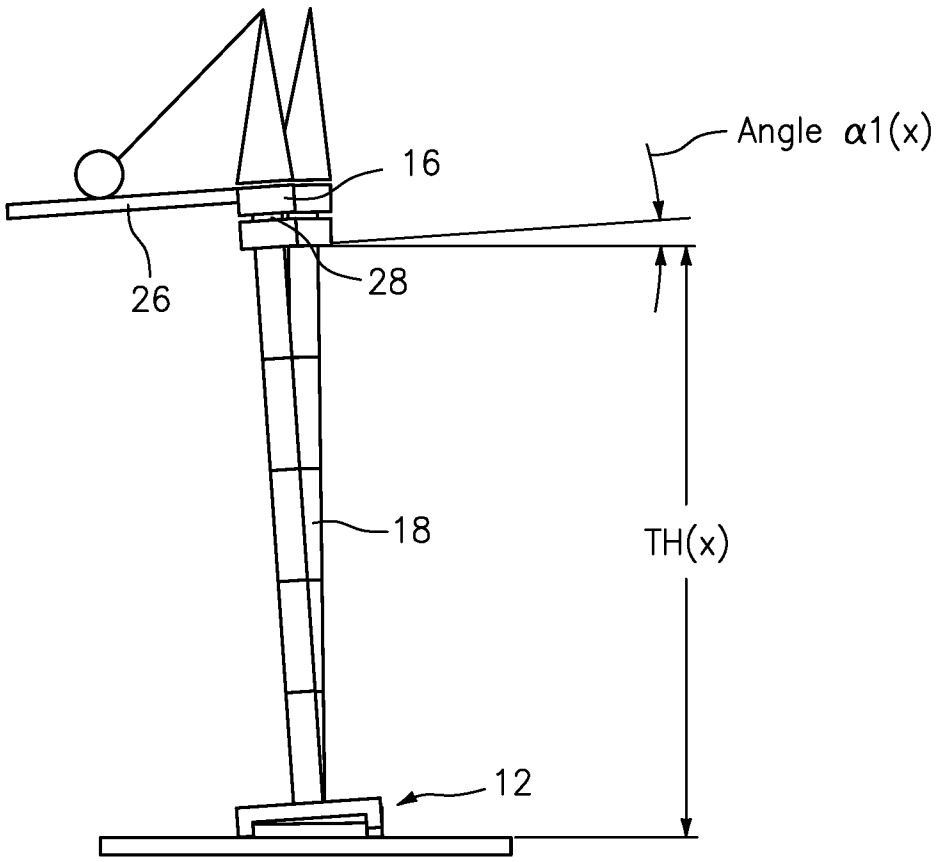
FIG. 4 a simplified schematic side view of the revolving tower crane with the assembled counter-boom.

FIG. 4 shows the further assembly steps, namely the assembly of the counter-boom 26. The counter-boom 26 and the hoist winch in this respect generate a torque from which an inclination results as a consequence in conjunction with the tower height.

The inclination is determined by the tilt sensor 28, with the angle $\alpha\mathbf{1}(x)$ being logged. If the angle $\alpha\mathbf{1}(x)$ is larger than a permitted angle, a warning signal is output. An angle of rotation sensor also has to be used in this respect to determine the position-dependent inclination of the tower. The inclination pattern is then rotated by 360° and is completely mapped in conjunction with the wind measurement.

Figure 5:
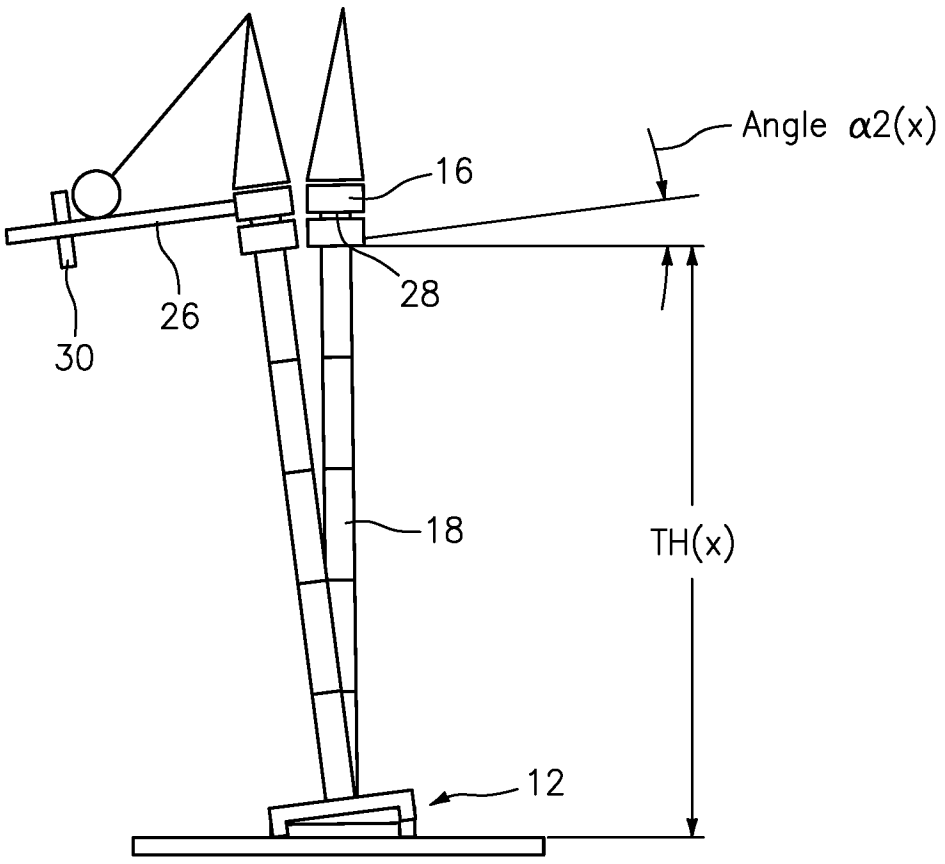
FIG. 5 a simplified schematic side view of the revolving tower crane with assembly counter-ballast.

If the permitted inclination has not been exceeded, the release takes place for the placing on of the assembly counter-ballast 30, as shown in FIG. 5. The angle $\alpha 2(x)$ is in this respect again determined in dependence on the tower height/tower combination (x) and is compared with the stored values.

Figure 6:
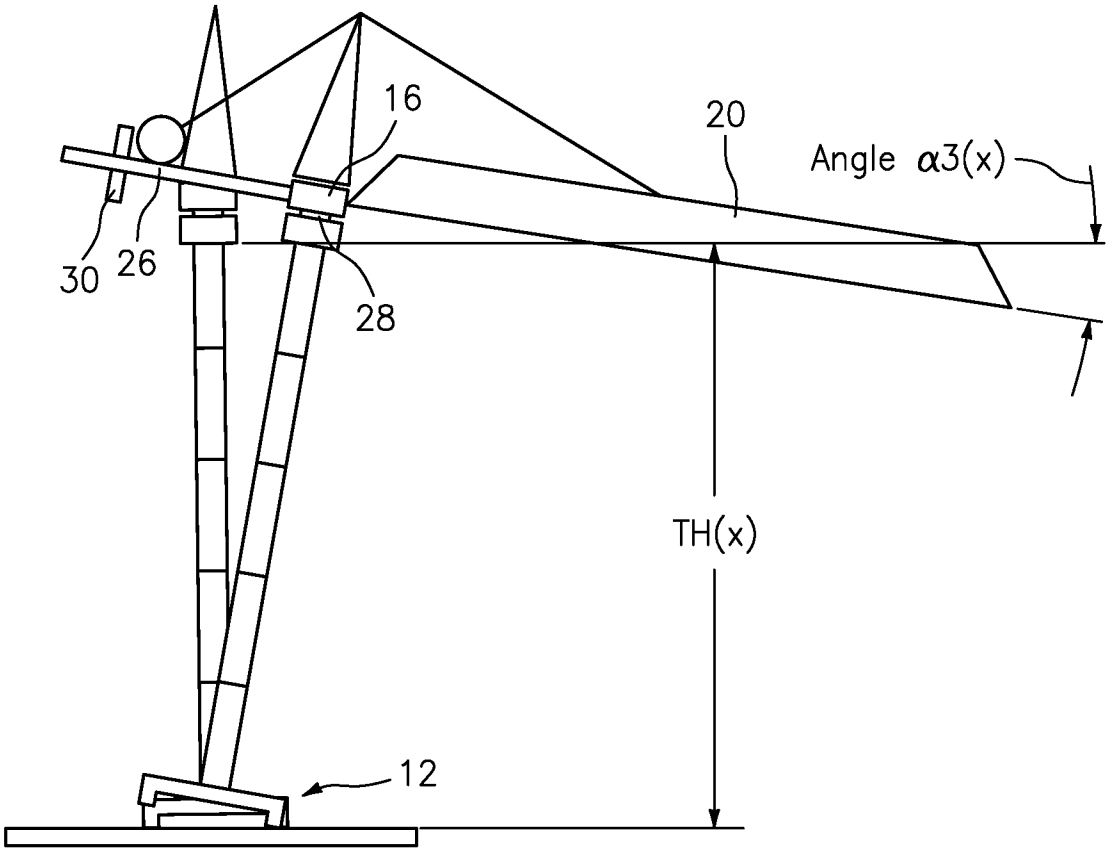
FIG. 6 a simplified schematic side view of the revolving tower crane with an assembled boom.

The boom 20 is then assembled, as shown in FIG. 6, and the inclination is determined using the angle $\alpha 3(x)$. This is admittedly larger in comparison with the angle $\alpha 2(x)$, but a permissible, but also necessary inclination confirms that the counter-ballast matches the assembled boom length. The inclination is noted again to log an intermediate step.

Figure 7:
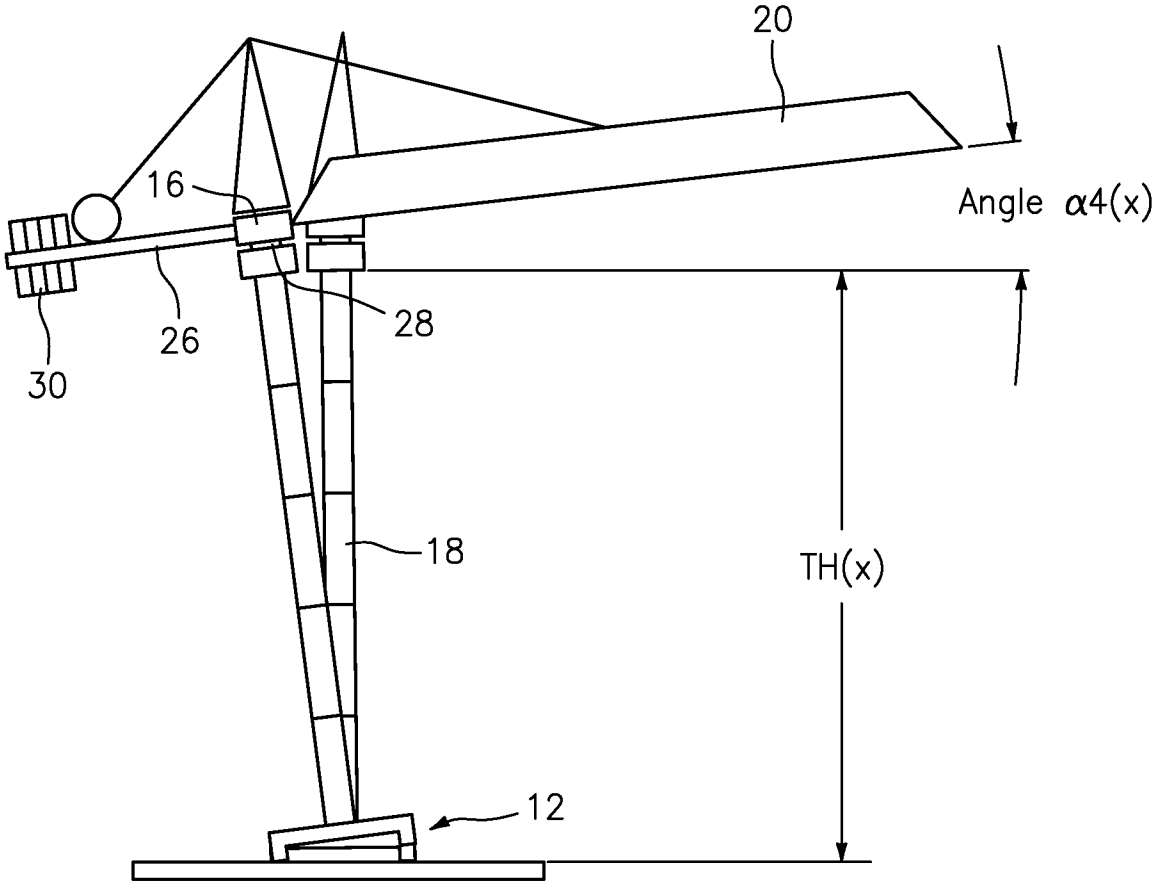
FIGS. 7-9 a simplified schematic side view of the revolving tower crane with completed counter-ballast and an assembled trolley at the tower and at the boom tip.
Figure 8:
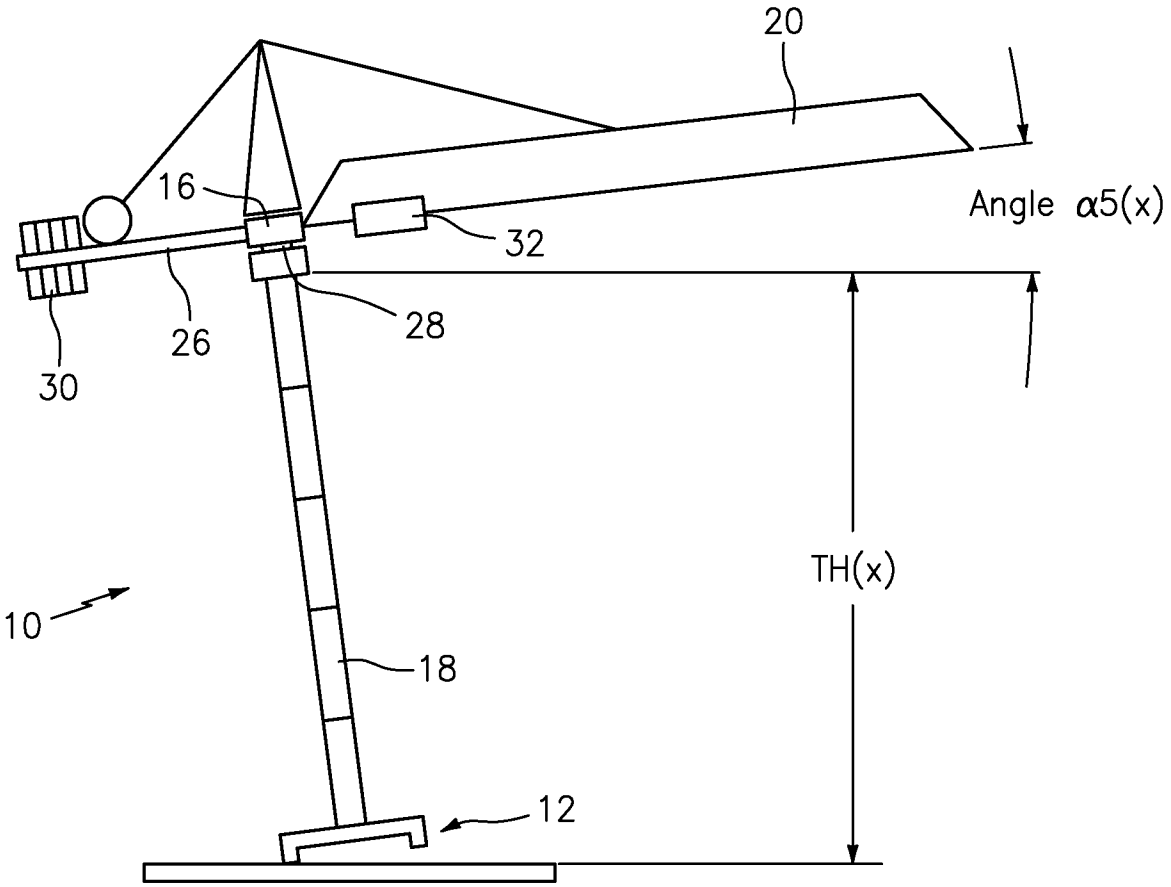
Figure 9:
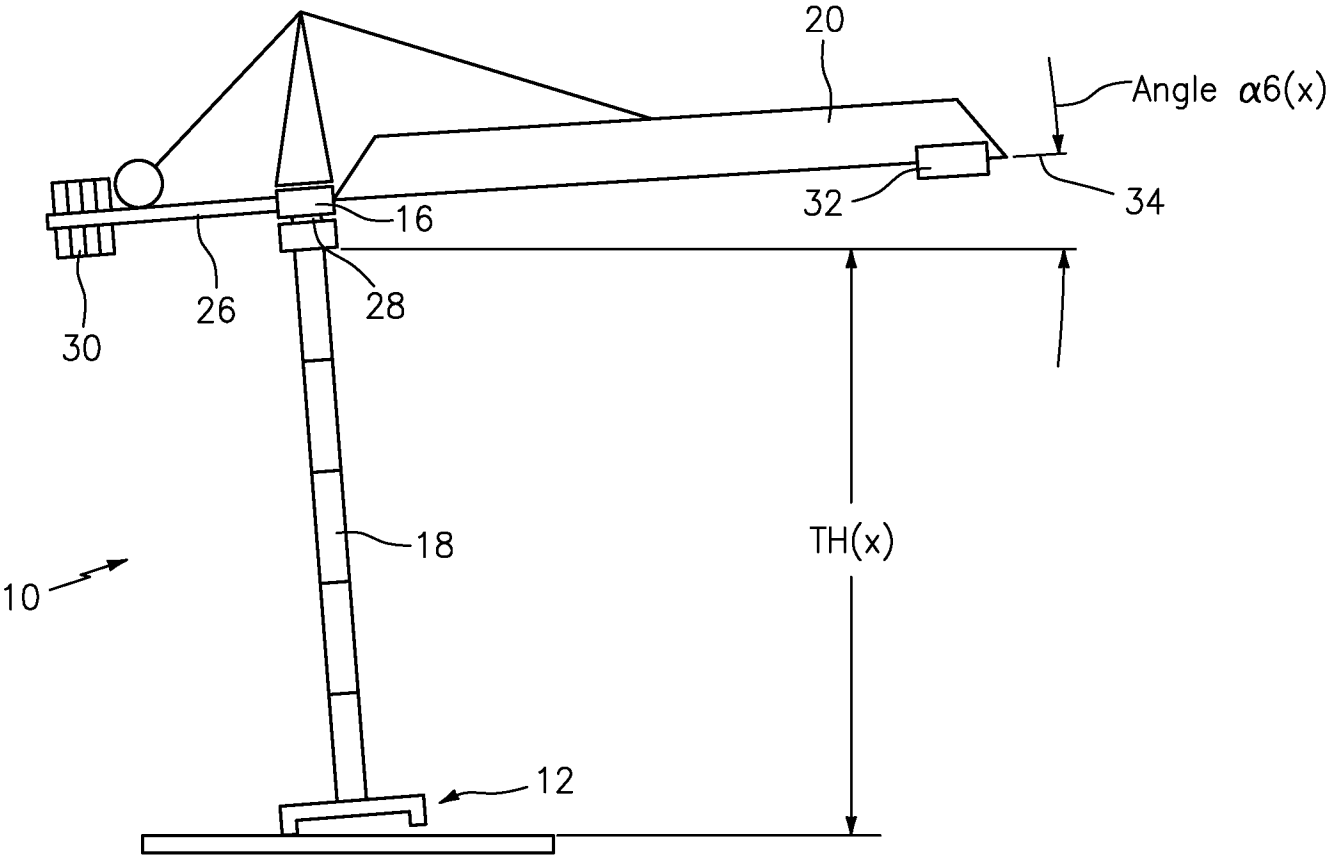

FIG. 7 shows the trolley in the assembly position. The counter-ballast 30 is completed in this respect and the angle $\alpha 4(x)$ is determined. The crane is rotated by 360° to confirm the admissibility of the inclinations for the fixed configuration of the crane. This can take place with the trolley 32 at the tower, as shown in FIG. 8, and/or with the trolley 32 at the boom tip 34, as shown in FIG. 9. In this respect, the respective angles $\alpha 5(x)$ and $\alpha 6(x)$ are determined and are compared with the permitted angles.

Figure 10:
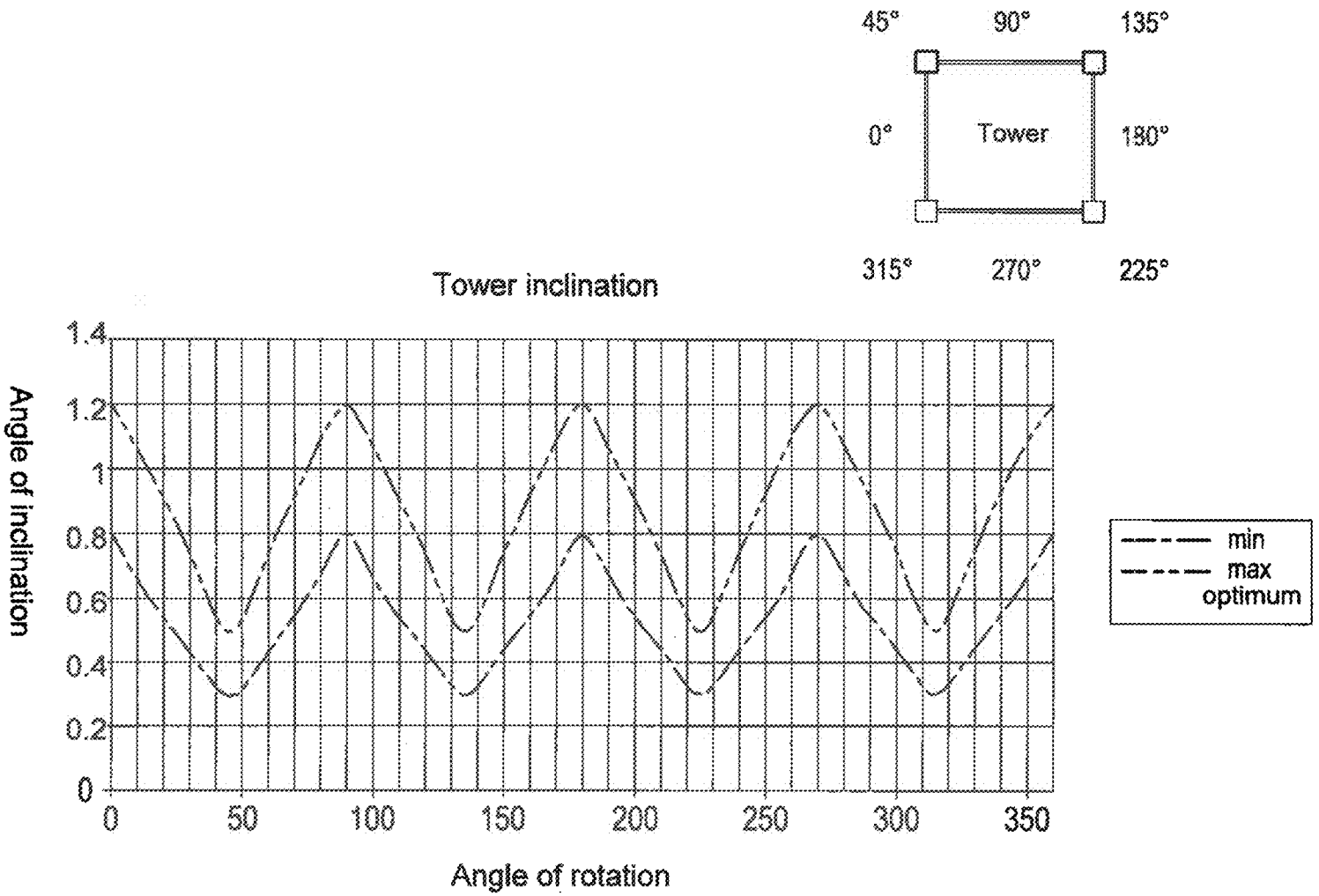
FIG. 10 a graphical representation of the angular curve prepared in the inclination monitoring.

As shown in FIG. 10, an angle curve is prepared during whose monitoring the inclinations are compared with current loads. The possible deviations are then logged. The procedure is similar for all the functions in this respect. The inclination angle is determined and is indeed used in dependence on the position with respect to the tower and the function "max and min", i.e. the setting of an interval as a limit for the warnings or shut-downs.

Figure 11A:
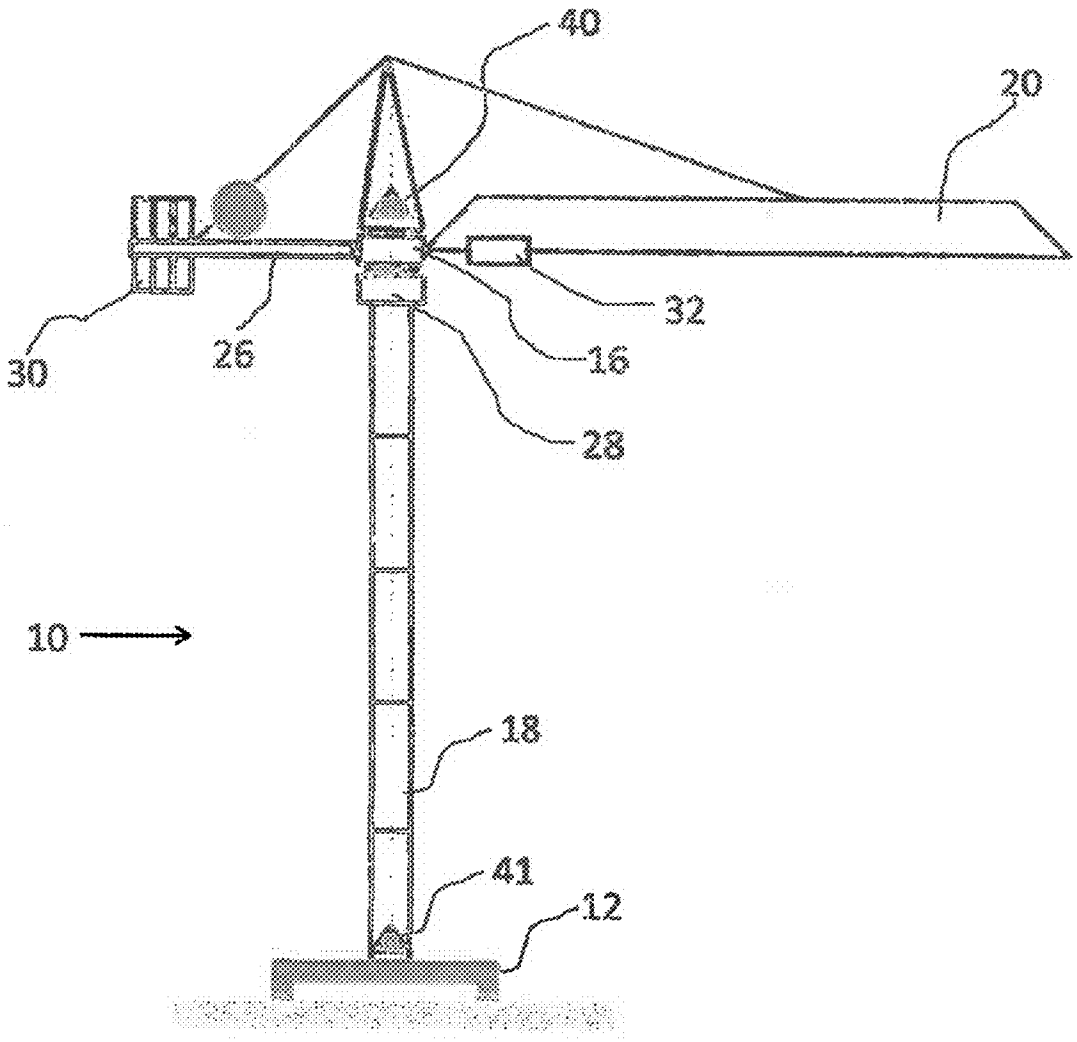
FIGS. 11 *a-c* a simplified schematic side view of a revolving tower crane in accordance with a second embodiment of the invention.
Figure 11B:
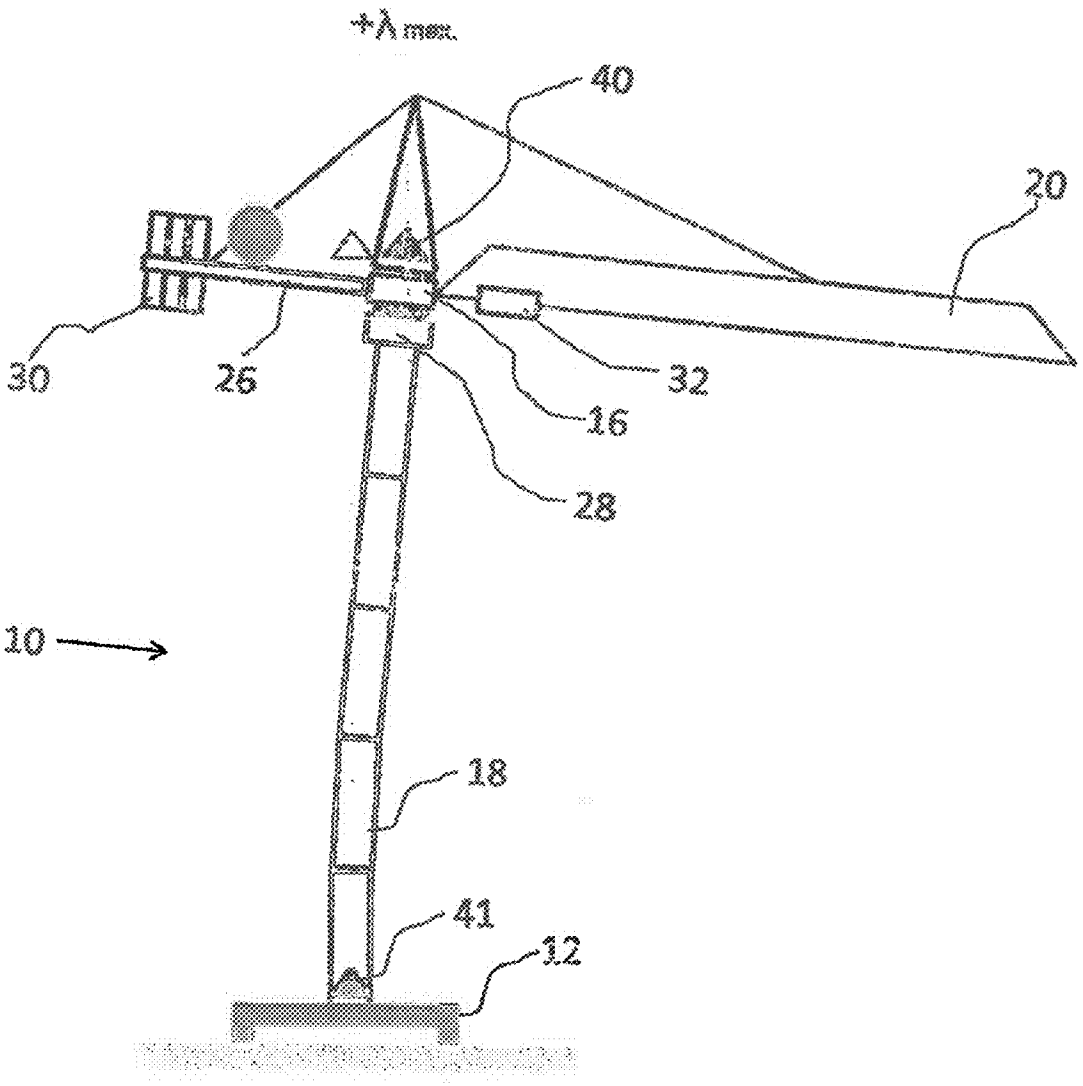
Figure 11C:
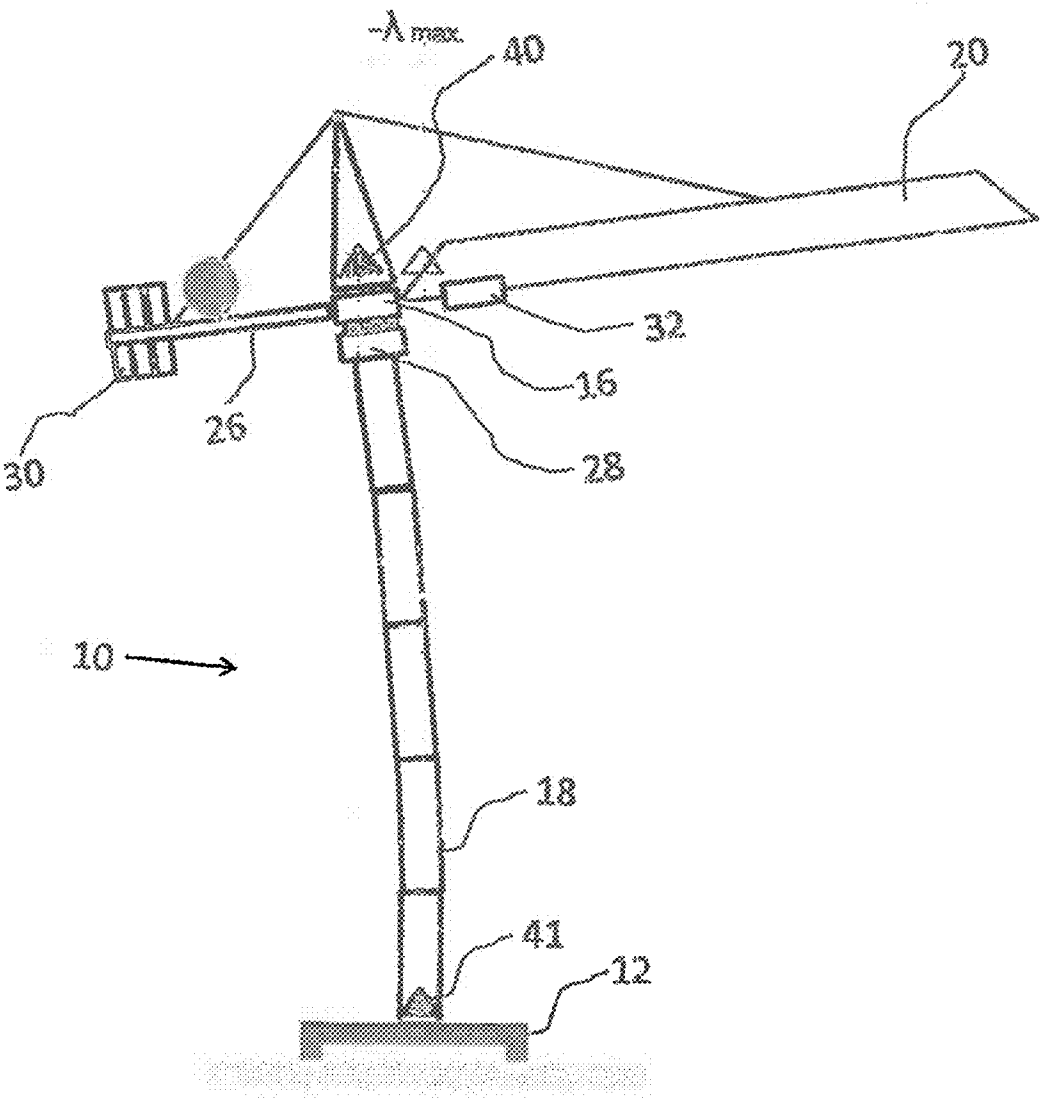

A respective second embodiment of the revolving tower crane in accordance with the invention is shown in FIGS. 11 *a-c*. The same reference numerals have the same meaning as those in the previously discussed first embodiment. This embodiment is a revolving tower crane 10 that rotates at the top and in which the boom 20 is rotatably supported at the upper end of the tower 18. The tilt sensor 28 is arranged close to the revolving deck 16.

In the embodiment shown here, the inclination can be achieved in addition to a tilt sensor 28 or instead of a tilt sensor 28 by a pair of GPS transponders 40 and 41. While the GPS transponder 40 is arranged at the tip of the tower 18, the second GPS transponder 41 is arranged at the substructure or base of the lower part of the crane 10. The difference of the GPS signals of the two transponders enables a determination of the inclination from the position of rest as shown with reference to FIGS. 11 *a* (position of rest without inclination), 11 *b* (deflection in one direction) and 11 *c* (deflection in the other direction).

The invention claimed is:

1. A system for monitoring safety of a revolving tower crane having a revolving deck, a substructure and a tower, wherein the system has a sensor system, a crane control, and at least one tilt sensor attached and installed at the revolving deck for monitoring the safety during raising and lowering of the revolving tower crane, after the revolving deck is installed on the crane and as the revolving deck is raised up the tower.

2. A system in accordance with claim 1, wherein said at least one tilt sensor also monitors the safety during operation of the erected crane.

3. A method of monitoring safety of a revolving tower crane having a revolving deck, a sensor system, a crane control, and at least one tilt sensor, comprising the steps of attaching and installing the at least one tilt sensor at the revolving deck, monitoring crane safety during raising and lowering of the revolving tower crane, raising of the crane starts with assembly of a tower on a substructure, then placing the revolving deck having the installed at least one tilt sensor on the substructure, starting the monitoring after the placing on of the revolving deck, and continuing the monitoring as the revolving deck is raised toward a top of, the tower.

4. A method in accordance with claim 3, wherein position of the revolving deck is determined via the at least one tilt sensor and received measured values are transmitted to the crane control for evaluation, with an action being triggered on exceeding a predefined limit value.

5. A method in accordance with claim 3, wherein inclination of the revolving deck determined by the at least one tilt sensor is compared with inclination values provided for the respective setup, with a warning signal being output on exceeding of a permitted tilt or angle of inclination, and the determined data being logged.

6. A method in accordance with claim 3, wherein a correction of the data determined by the at least one tilt sensor is carried out in conjunction with values determined via a provided wind gauge.

7. A method in accordance with claim 3, wherein inclination results from a torque generated by a counter-boom and a hoist winch and in dependence on the height of the tower of the revolving tower crane after the assembly of the counter-boom, with the resulting inclination being determined by the at least one tilt sensor and being compared with data stored in the crane control.

8. A method in accordance with claim 3, wherein an angle of rotation sensor is provided in addition to the at least one tilt sensor to determine position-dependent inclination of the tower, for placing of counter-ballast on the assembly.

9. A method in accordance with claim 3, wherein an angle of inclination a(x) is determined after the assembly of the boom and is noted to log an intermediate step.

10. A method in accordance with claim 3, wherein counter-ballast is added in a further method step, with the correctness of permitted inclinations for a fixed configuration of the crane being confirmed by a full rotation of the crane thus set up by 360°, and the rotation being able to take place with an installed trolley at the tower and/or with a trolley at the boom tip.

11. A method in accordance with claim 3, wherein the crane is rotated by 360° after adding counter-ballast to confirm the correctness of inclinations for a fixed configuration.

12. A method in accordance with claim 3, wherein monitoring also takes place during lowering of the boom and/or a counter-boom such that a warning signal is output on an exceeding of permitted inclination values.

13. A method in accordance with claim 3, wherein inclinations are recorded in the crane control and compared in the form of a load curve with current load torques, with any deviations being logged.

14. A method in accordance with claim 3, wherein an angle of inclination in dependence on load torque/static torque and an angle of rotation of the crane, are constantly monitored during operation, with deviations from permitted stored values being displayed.

15. A method in accordance with claim 3, wherein inclination is monitored during the raising and lowering of the revolving tower crane.

* * * * *